United States Patent [19]

Kuhn, Jr.

[11] Patent Number: 4,995,226

[45] Date of Patent: Feb. 26, 1991

[54] SAFETY STIRRUP

[76] Inventor: George F. Kuhn, Jr., 721 Harrison City Rd., Trafford, Pa. 15085

[21] Appl. No.: 377,721

[22] Filed: Jul. 10, 1989

[51] Int. Cl.[5] ..... B68C 3/02

[52] U.S. Cl. ..... 54/49

[58] Field of Search ..... 54/47, 49

[56] References Cited

U.S. PATENT DOCUMENTS

| | | | |
|---|---|---|---|
| 233,647 | 10/1880 | Waehlte | 54/49 |
| 889,018 | 5/1908 | Jones | 54/49 |
| 1,392,673 | 10/1921 | Baker | 54/47 |

FOREIGN PATENT DOCUMENTS

| | | | |
|---|---|---|---|
| 5185 | of 1900 | United Kingdom | 54/49 |

*Primary Examiner*—Robert P. Swiatek

*Attorney, Agent, or Firm*—Ronald S. Lombard

[57] ABSTRACT

A safety stirrup particularly adaptable to a western-type saddle is disclosed. The safety mechanism of the stirrup is entirely hidden and outwardly appears to be a standard stirrup. The stirrup utilizes a camming mechanism to release the foot portion of the stirrup upon a rider being in an unnatural position to prevent possibility of serious injury.

13 Claims, 4 Drawing Sheets

SAFETY STIRRUP

BACKGROUND OF THE INVENTION

This invention relates to stirrups to be used in conjunction with horseback riding and, more particularly, to a safety stirrup designed to prevent serious injury to a horseback rider in the event he or she is thrown from a horse.

Over the years a number of stirrup safety devices have been disclosed. Such as in U.S. Pat. No. 356,748, issued to D. B. Comly, dated Feb. 1, 1887. The Comly stirrup includes a foot loop having its side bars united together at the upper ends. The stirrup is also provided with a trip or tow bar extending across the face of the foot loop. The lower end of the yoke is provided with means whereby the foot loop and detachable yoke may be interlocked. Upon a rider being thrown from the horse the foot loop would be detached from the yoke.

In U.S. Pat. No. 725,204 issued to J. M. Birtels, dated Apr. 14, 1903, is disclosed a stirrup including a stirrup-iron having projecting arms constituting a socket and a rod connecting to arms. A loop-iron is detachably held between the arms and recessed to engage the rod. In case of an accident or throwing of a rider the loop rocks upon a rod and disengages from the stirrup-iron, leaving the latter on the rider's foot. Another such safety stirrup is disclosed in U.S. Pat. No. 2,537,532 issued to E. Hrabal, dated Jan. 9, 1951. The Hrabal invention discloses a safety stirrup including a pair of jaws pivoted together at their upper ends. Means at the pivoted ends are provided for suspending the jaws on a strap. Yielding means are provided to hold the jaws closed and interdigitating pins are carried at the lower end of the jaws and include notches in their upper surfaces. A suspension plate on the stirrup extends between the lower end of the jaws and a plate is provided including holes for receiving the pins. When a rider becomes unbalanced the stirrup may rock and force the jaws to open against the effort of the spring so that the pins become withdrawn from the openings.

In U.S. Pat. No. 3,910,015 issued to Errol Ebejer dated Oct. 7, 1975, is disclosed a stirrup comprising a platform and support structure adapted for suspending the platform from saddle leather whereby a rider's foot may be accepted thereon. The structure includes a portion displaceable in respect to the platform when an excessive load is applied whereby the rider's foot may be extracated from the stirrup in an emergency.

As can be seen from the foregoing references the prior art has disclosed safety stirrups which are generally complex and are often limited as to direction of release and are susceptible to malfunction due to rust, corrosion and dirt and close tolerances of moving parts.

SUMMARY OF THE INVENTION

The aforementioned difficulties of the prior art are overcome by the present invention.

One object of the present invention is to provide a safety stirrup that releases on the event a horseback rider is in an unnatural position on a horse with limited modification of a standard stirrup.

A further object of the present invention is to provide a stirrup which releases in the event a rider is thrown during a forward direction or à backward direction or in the event the saddle slips under the horse.

And still a further object of the present invention is to provide a safety stirrup which is reliable and of simple construction. Yet a further object of invention is to provide ability to quickly interchange the safety stirrup of the present in place of a standard stirrup without changing the length from the seat or heighth of the stirrup from the ground while providing an unseen safety apparatus for cosmetic purposes. A standard stirrup may be readily converted to the safety stirrup of the present invention.

The safety stirrup of the present invention comprises a substantially U-shaped flexible bottom frame. The U-shaped frame includes a foot rest portion and a pair of side members extending upwardly from the foot rest portion. A hollow hub is affixed to the U-shaped frame on the interior side thereof proximate each end of the side members. A rotatable axle is provided extending horizontally between the hubs. The axle includes substantially cylindrical solid hub engaging end portions. The end portions of the axle are housed within the hubs. The hubs on the interior surface have a nub affixed thereto which protrudes radially inwardly at the lowest point on the interior surface of the hub in predetermined position.

One of the axle end portions has a first U-shaped nub engaging channel therein on the underside thereof. The other of the axle end portions has a second U-shaped nub engaging channel therein on the underside thereof.

The first U-shaped channel opens towards the adjacent end of the axle and the second U-shaped channel opens towards the other end of the axle. The first U-shaped channel and the second U-shaped channel are each bisected by an imaginary coaxial line extending along the lowest point on the underside of the axle between the ends of the axle. The first U-shaped channel and the second U-shaped channel each have a central locking portion. The central locking portion of the first U-shaped channel and the central locking portion of the second U-shaped channel are in substantial parallel relationship to one another and are substantially equally distant from the the respective ends of the axle. The first U-shaped channel and the second U-shaped channel each have nub camming and receiving portions adjacent each side of the central portion. The nub camming and receiving portions each forming a nub receiving notch in the ends of the axle.

Utilizing the safety stirrup of the present invention when the U-shaped flexible bottom frame member is rotated to the extent that the nub enters the nub camming and receiving portions of the U-shaped channel the side members of the frame are caused to simultaneously spread apart until the nub exits the U-shaped channel via the nub receiving notches thereby disengaging the frame from the axle thereby permitting a horseback rider's foot to be released from the stirrup to prevent the possibility of serious injury.

In one embodiment of the invention, the safety stirrup also includes an axle stabilizing member affixed to the axle on the upper side thereof. Desirably the nub camming and receiving portions are at a predetermined helical angle to the aforementioned imaginary coaxial line. The bottom of each of the nub receiving notches are a predetermined circumferential distance from the bottom of the ends of the axle.

Preferably the outer surface of the hubs are tapered such that the outer surface of the hub furthest from the proximate side member has a smaller diameter than the outer surface of the hub nearest the proximate side member. Also it has been found beneficial to have the inner surface of the hub tapered such that the diameter on the inner surface of the hub is greater at the inner most diameter than the outer most diameter. Preferably the hub engaging end portions are tapered to slideably engage the tapered interior surface of the hub.

In another embodiment of the invention, the safety stirrup further includes timing adjustment for synchronizing the release of the axle by each of the hubs. Preferably the timing adjustment comprises an outer flange affixed to the hubs. The outer flange has an aperture passing therethrough and a screw is fastened to the side members so the hubs release the ends of the axle simultaneously.

BRIEF DESCRIPTION OF THE DRAWINGS

For better understanding of the invention, reference may be had to the accompanying drawings, in which.

BRIEF DESCRIPTION OF THE PREFERRED EMBODIMENTS

Figure 1:
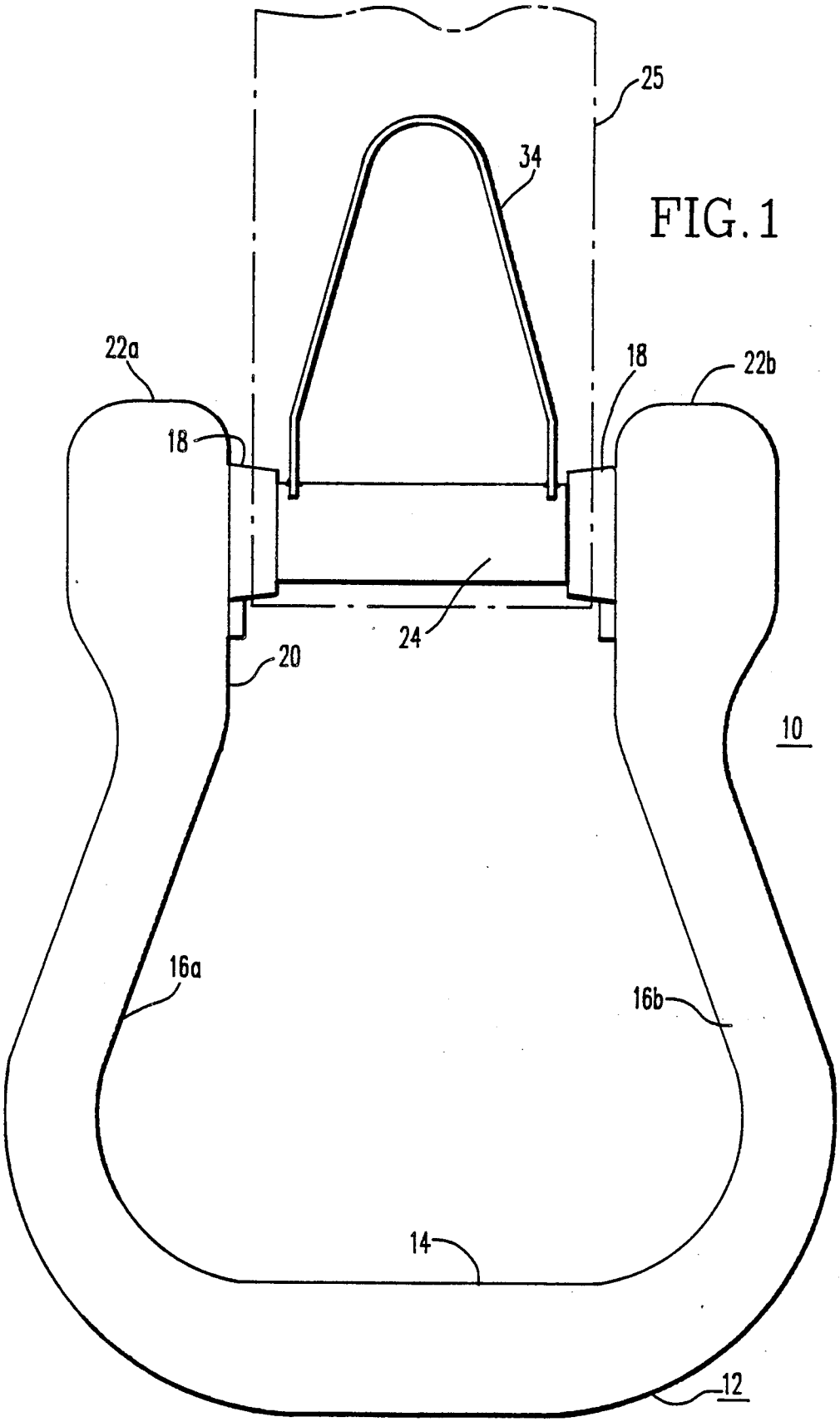
FIG. 1 is an elevational view of the safety stirrup of the present invention.
Figure 3:
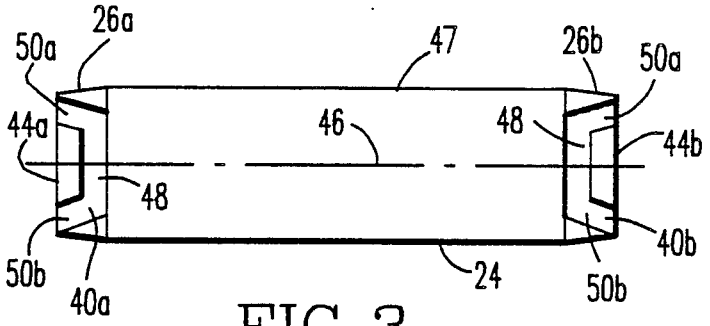
FIG. 3 is a bottom view of the axle, shown in FIG. 2.
Figure 5A:
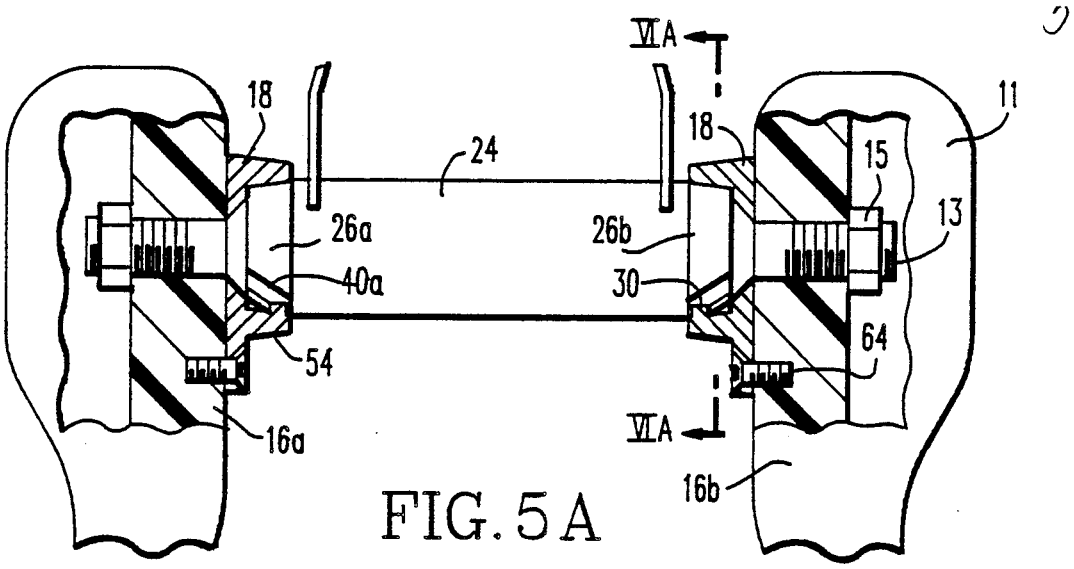
FIG. 5A is enlarged elevational view partially broken away of the axle engaging the hubs during normal use of the stirrup.
Figure 9:
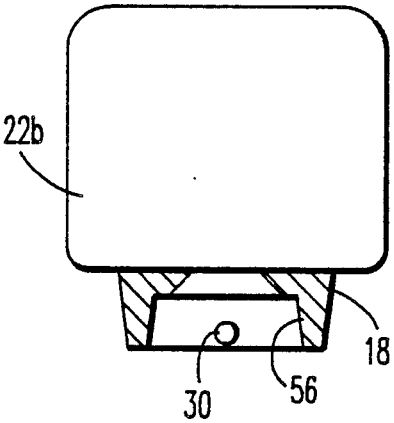
Figure 7:
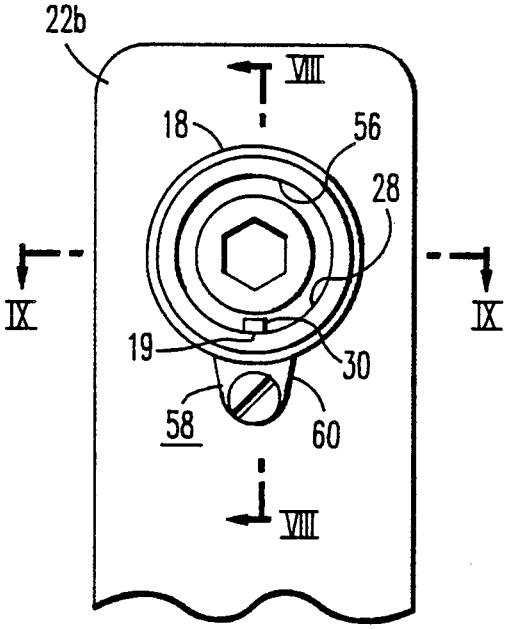
FIG. 7 is an elevational view of the hub mounted on a side member.
Figure 8:
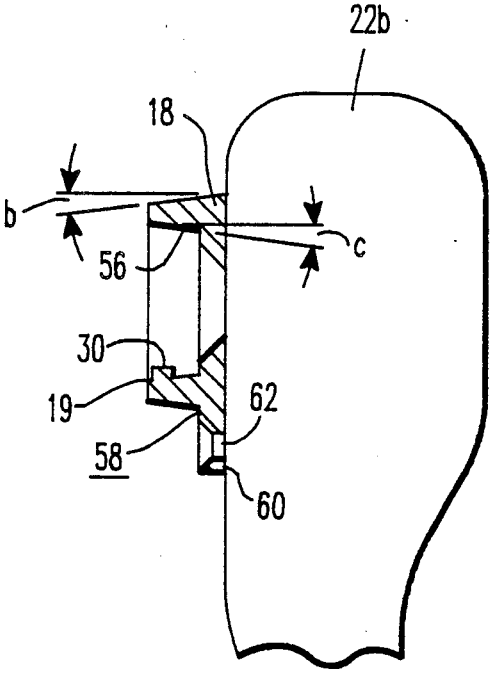
FIG. 8 is a cross-sectional elevational view taken along the line VIII—VIII of FIG. 7; and, FIG. 9 is a cross-sectional plan view taken along the line IX—IX of FIG. 7.

Referring to FIG. 1 there is shown a safety stirrup 10 comprising a substantially U-shaped flexible bottom frame 12 including a foot rest portion 14 and a pair of side members 16*a* and 16*b* generally made of plastic or wood extending upwardly from the foot rest portion. The stirrup may have a leather wrapping 25. The stirrup described thus far is well known in the art. Hollow hubs 18 are affixed to the U-shaped frame 12 on the interior side 20 of the frame 12 by bolts 13 and nuts 15, for example, as shown in FIG. 5A. The hollow hubs 18 are positioned proximate each end 22*a*, 22*b* of the side members 16*a*, 16*b*. A rotatable axle 24 extends horizontally between the hubs 18 as shown in FIG. 1 and FIG. 5A. The axle 24 includes substantially cylindrical solid hub engaging end portions 26*a*, 26*b*, as shown in FIG. 3. The end portions 26*a*, 26*b* of the axle 24 are housed within the hubs 18 during normal use of the stirrup. Hubs 18 on the interior surface 28 thereof have a nub 30 as shown in FIGS. 7 and 8 affixed thereto protruding radially inwardly at the lowest point 19 on the interior surface of the hub 18 in predetermined position as shown in FIGS. 7–9.

Figure 2:
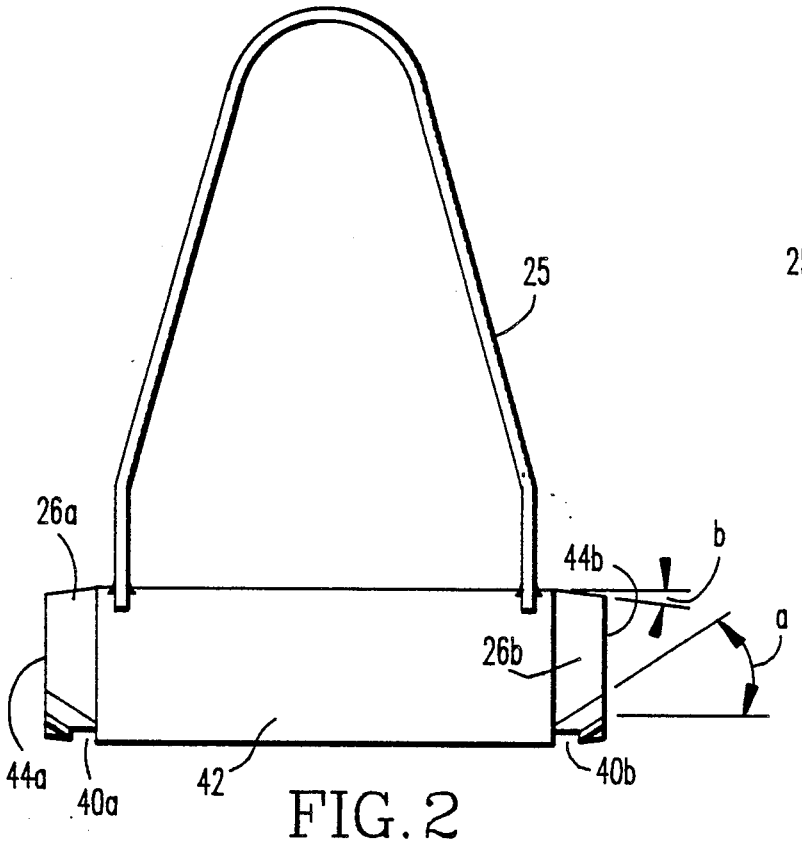
FIG. 2 is an elevational view of the axle showing the strap engagement member affixed thereto.

Preferably a strap engagement member 34 is affixed to the axle 24 on the upper side 36 thereof for engaging a leather strap 25, as shown in FIG. 2. The leather strap 25 attaches to the saddle (not shown) as is known in the art. This invention is particularly adapted to the western-type saddle.

One of the axle end portions 26*a* has a first U-shaped nub engaging channel 40*a* on the under side 42 as shown in FIGS. 2 and 3. The other axle end portion 26*b* has a second U-shaped nub engaging channel 40*b* on the underside 42 of the axle 24. The first U-shaped channel 40*a* opens toward one end 44*a* of the axle 24. The second U-shaped channel 40*b* opens toward the other end 44*b* of the axle 24 as shown in FIG. 3.

Figure 4:
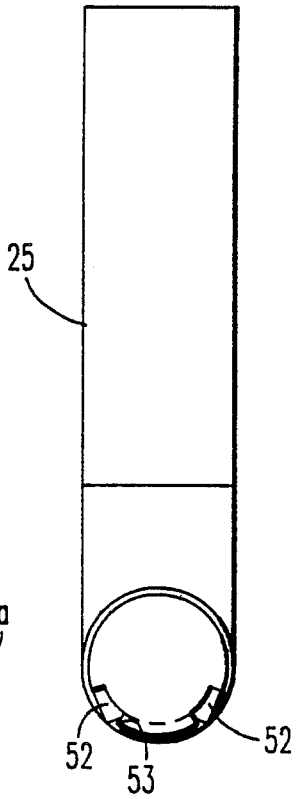
FIG. 4 is a side elevational view of the axle shown in FIG. 3.

The first U-shaped channel 40*a* and the second U-shaped channel 40*b* are each bisected by an imaginary coaxial line 46 as shown in FIG. 3 extending along the lowest point on the underside 47 of the axle 24 between the ends 44*a*, 44*b* of the axle. The first U-shaped channel 40*a* and the second U-shaped channel 40*b* each have a central locking portion 48. The central locking portion 48 of the first U-shaped channel 40*a* and the central locking portion 48 and the second U-shaped channel 40*b* are in substantial parallel relationship and substantially equally distant from the respective ends 40*a*, 40*b* of the axle 24. The first U-shaped channel 40*a* and the second U-shaped channel 40*b* each include nub camming and receiving portions 50*a*, 50*b* adjacent each side of the central locking portion 48. The nub caming and receiving portions 50*a*, 50*b* are at a predetermined helical angle, shown as angle a in FIG. 2, from the imaginary coaxial line 46, such as about 35°, for example. The nub camming and receiving portions 50*a*, 50*b* each form a nub receiving notch 52 in the ends 44*a*, 44*b* of the axle 24 shown in FIG. 4. Each of the nub receiving notches 52 has a bottom side 53 being a predetermined circumferential distance from the imaginary coaxial line 46, such as ⅛ the circumference of axle 24.

Figure 5B:
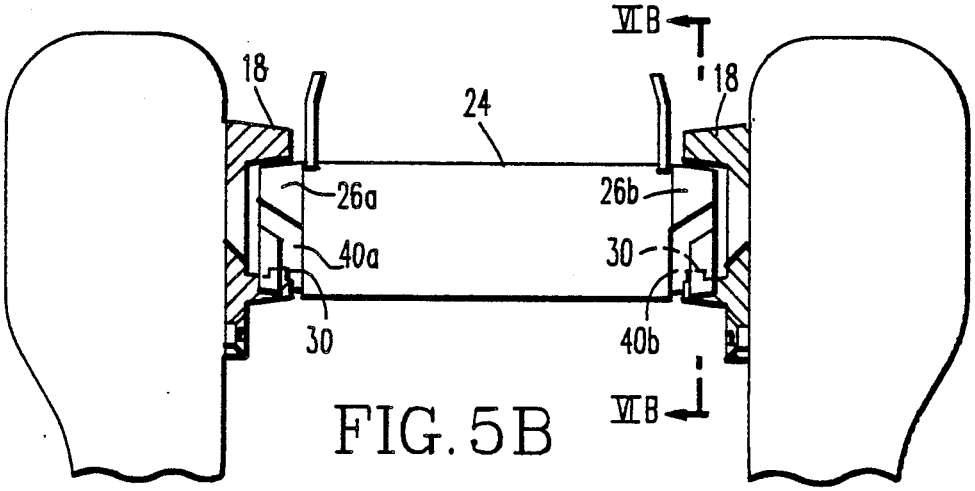
FIG. 5B is the same as shown in FIG. 5*a* with the exception that the U-shaped frame has rotated relative to the normal use position and the axle has begun to separate from the hubs.
Figure 5C:
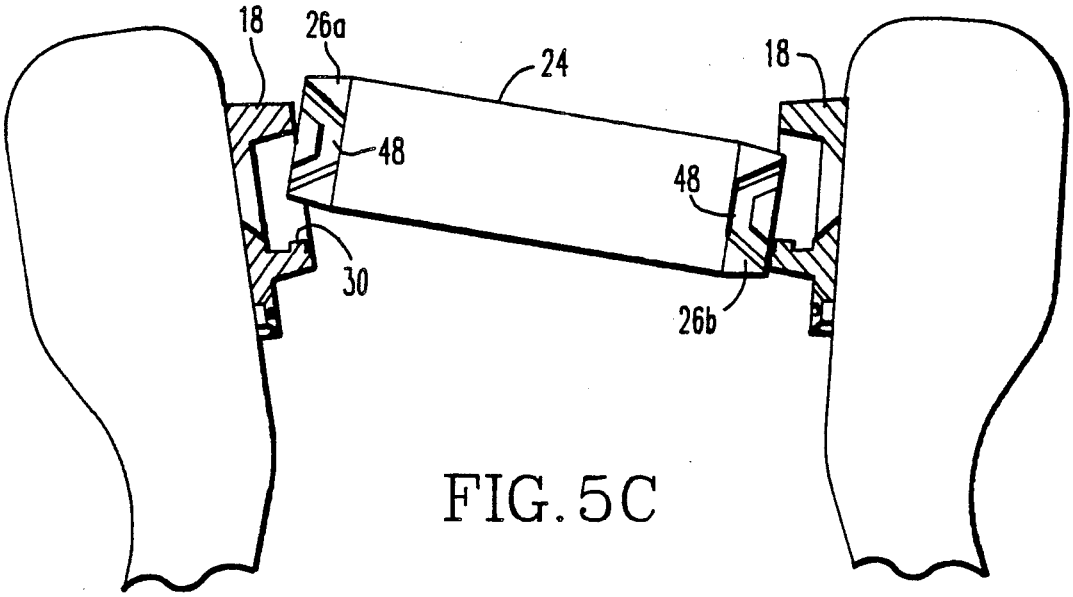
FIG. 5C shows the axle just separating from the hubs during the event of a rider being thrown from a horse for example.
Figure 6A:
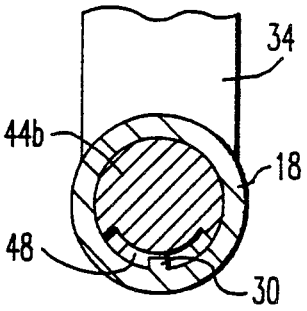
FIG. 6A is a cross-sectional elevational view taken along the line VIA-VIA of FIG. 5A showing a nub within the central locking portion of the first U-shaped channel during normal use.
Figure 6B:
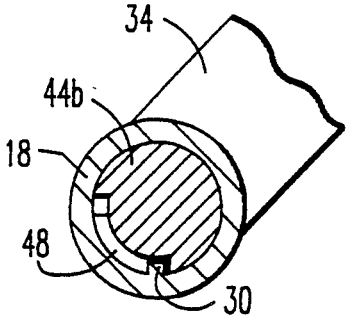
FIG. 6B is a cross-sectional elevational view taken along the line VIB—VIB of FIG. 5*b* showing a nub in the nub camming and receiving portion before release of the axle.

Referring to FIGS. 5A–5C and 6A, 6B, the safety stirrup of the present invention functions when the U-shaped flexible bottom frame 12 of the stirrup is rotated in either direction to the extent the nub 30 enters the nub camming and receiving portions 50*a* or 50*b* of the U-shaped channel 40*a*, 40*b*. Side members 16*a*, 16*b* of the frame 12 are caused to simultaneously spread apart by the camming action of the nub camming and receiving portions 50*a* or 50*b* as shown in FIG. 5B until the nub 30 exits the U-shaped channels 40*a*, 40*b* via the nub receiving notch 52, thereby disengaging the frame 12 from the axle 24 thereby permitting a horseback rider's foot to be released from the stirrup 10 to prevent the possibility of a serious injury. During normal riding the weight of the rider with his feet in the stirrups aids in maintaining the nub 30 in the central locking portion 48.

Preferably the outer surface 54 of the hub 18 is tapered as shown in FIG. 8 angle by such that the outer surfaces of the hub 18 farthest from the side member 18 has a smaller diameter than the outer surface 54 nearest the side member. A taper of 2° has been found to work well. The taper eliminates any possibility of leather strap 25 binding upon operation of the safety function of the present invention.

Also it is desirable that the inner surface 56 of the hub 18 is tapered such that the diameter of the hub is greater adjacent the respective side member 16*a*, 16*b* than the outer most diameter. Preferably the end portions 26*a*, 26*b* of the axle 24 are tapered such that they slideably engage the tapered interior surface 56, shown as angle C in FIG. 8, of the hub 18. This prevents binding between the end portion 26*a*, 26*b* and the hub 18 upon operation of the safety function. Preferably the tapered interior surface 56 of the hub and said end portions 26*a*, 26*b* have a 2° taper.

The safety stirrup 10 of the present invention also desirably includes timing adjustment 58 shown in FIGS. 7 and 8 for synchronizing the release of the axle 24 by each of the hubs 18. The timing adjustment 58 includes an outer flange 60 affixed to the hub 18. The outer flange 60 has an aperture 62 passing therethrough. A screw 64 passes through aperture 60 and is affixed to the side member 16*a*, 16*b*. By adjusting the position of the flange relative to the side member simultaneous hub release may be obtained when that point is located, the screw 64 is inserted and aperture 60 is made and the flange is attached to the side 16*a*, 16*b*.

The stirrup 10 may be easily made from a standard stirrup by disassembling the standard stirrup and converting it to the safety stirrup 10 of the present invention by utilizing the side members 16*a*, 16*b* and foot rest portion 14 and leather covering if available of the standard stirrup.

I claim:

1. A safety stirrup comprising a substantially U-shaped flexible bottom frame, said U-shaped frame including a foot rest portion and a pair of side members extending upwardly from said foot rest portion, hollow hub means affixed to said U-shaped frame on the interior side thereof proximate the ends of said U-shaped frame, rotatable axle means extending horizontally between said hub means, said axle means including substantially cylindrical solid hub engaging end portions, said axle end portions being housed within said hub means, said hub means on the interior surface thereof having a nub means affixed thereto protruding radially inwardly at the lowest point on said interior surface of said hub means in predetermined position, one of said axle end portions having a first U-shaped nub engaging channel therein on the underside thereof, the other of said axle end portions having a second U-shaped nub engaging channel therein on the underside thereof, said first U-shaped channel opening towards the adjacent end of said axle means, said second U-shaped channel opening towards the other end of said axle means, said first U-shaped channel and said second U-shaped channel each being bisected by an imaginary coaxial line extending along the lowest point on the underside of said axle means between the ends of said axles, said first U-shaped channel and said second U-shaped channel each having a central locking portion, said central locking portion of said first U-shaped channel and said central locking portion of said second U-shaped channel being in substantial parallel relationship and substantially equally distant from the respective ends of said axle means, said first U-shaped channel and said second U-shaped channel each having nub camming and receiving portions adjacent each side of said central locking portion, said nub camming and receiving portions each forming a nub receiving notch in said ends of said axle means, whereby when said U-shaped flexible bottom frame member is rotated to the extent said nub means enters said nub camming and receiving portions of said U-shaped channel, said side members of said frame member are caused to simultaneously spread apart until said nub means exits said U-shaped channel via said nub receiving notch, thereby disengaging said frame member from said axle means thereby permitting a horseback rider's foot to be released from said stirrup to prevent the possibility of serious injury.

2. The safety stirrup of claim 1, further comprising a strap engagement member affixed to said axle means on the upper side thereof.

3. The safety stirrup of claim 1, wherein said nub camming and receiving portions are at a predetermined helical angle to said imaginary coaxial line.

4. The safety stirrup of claim 3, wherein said helical angle is about 35°.

5. The safety stirrup of claim 1, wherein the bottom side of each of said nub receiving notches are a predetermined circumferential distance from said imaginary coaxial line.

6. The safety stirrup of claim 1, wherein the outer surface of said hub means is tapered such that the outer surface of said hub means furthest from said side member has a smaller diameter than the outer surface of said hub means nearest said side member.

7. The safety stirrup of claim 6, wherein the outer surface of said hub means has about a 2° taper.

8. The safety stirrup of claim 1, wherein said inner surface of said hub means is tapered such that the hub diameter on the inner surface of the hub means is greater at the innermost diameter proximate said side member than at the outermost diameter furthest from said side member.

9. The safety stirrup of claim 8, wherein the inner surface of said hub has about a 2° taper.

10. The safety stirrup of claim 8, wherein said end portions of said axle means are tapered such that said end portions slideably engage said tapered interior surface of said hub means.

11. The safety stirrup of claim 10, wherein said end portions of said axle means have about a 2° taper.

12. The safety stirrup of claim 1, further comprising timing adjustment means for synchronizing the release of said axle means by each of said hub means.

13. The safety stirrup of claim 12, wherein said timing adjustment means comprising an outer flange affixed to said hub means, said outer flange having aperture means passing therethrough, screw means passing through said aperture means, said screw means affixed to said side members so said hub means releases said end portions of said axle means simultaneously.

* * * * *